US008100783B2

(12) United States Patent
Dodson

(10) Patent No.: US 8,100,783 B2
(45) Date of Patent: Jan. 24, 2012

(54) TENNIS SERVE TRAINING DEVICE

(76) Inventor: Lisa Dodson, Oakland, CA (US)

( * ) Notice: Subject to any disclaimer, the term of this patent is extended or adjusted under 35 U.S.C. 154(b) by 0 days.

(21) Appl. No.: 13/135,952

(22) Filed: Jul. 18, 2011

(65) Prior Publication Data

US 2011/0275460 A1 Nov. 10, 2011

Related U.S. Application Data

(63) Continuation of application No. 12/731,987, filed on Mar. 25, 2010.

(51) Int. Cl.
*A63B 69/38* (2006.01)

(52) U.S. Cl. ..... 473/459; 473/422; 473/423; 473/424; 473/425

(58) Field of Classification Search ..... 473/459, 473/461, 463, 464, 423–425, 549, 551
See application file for complete search history.

(56) References Cited

U.S. PATENT DOCUMENTS 1,917,236 A * 7/1933 Bloomstrand ..... 434/247
3,653,660 A * 4/1972 Malhas ..... 473/464
3,845,953 A * 11/1974 Malhas ..... 473/464
3,997,159 A * 12/1976 Malhas ..... 473/464
4,006,896 A * 2/1977 Soldavini ..... 473/551
4,022,467 A * 5/1977 Ruess ..... 473/464
4,249,729 A * 2/1981 Gabrielidis ..... 473/464
4,253,664 A * 3/1981 Daulton ..... 473/464
4,796,889 A * 1/1989 Muraour ..... 473/549
5,056,785 A * 10/1991 Robey ..... 473/459
5,064,203 A * 11/1991 Hattori ..... 473/551
5,501,451 A * 3/1996 Slusarczyk ..... 473/459
5,755,633 A * 5/1998 Marquez ..... 473/463
5,885,175 A * 3/1999 Marquez ..... 473/464
5,944,622 A * 8/1999 Buck et al. ..... 473/437
2005/0261075 A1* 11/2005 Pullaro ..... 473/256
2007/0105663 A1* 5/2007 Farnsworth et al. ..... 473/422
2007/0123373 A1* 5/2007 Emerson ..... 473/464
2008/0102992 A1* 5/2008 Novosel ..... 473/425
2009/0011875 A1* 1/2009 Drake et al. ..... 473/551

* cited by examiner

*Primary Examiner* — Raleigh W. Chiu
(74) *Attorney, Agent, or Firm* — Francis Law Group

(57) ABSTRACT

A tennis skill training device having grip emulating a tennis racquet grip sized to be held by a user. The device includes a grip, a single flexible umbilical having a first and second ends, the first end being attached to and emanating from the distal end of the grip, and a weight attached to the second end of the umbilical.

6 Claims, 2 Drawing Sheets

TENNIS SERVE TRAINING DEVICE

CROSS-REFERENCE TO RELATED APPLICATIONS

This application is a continuation of U.S. application Ser. No. 12/731,987, filed Mar. 25, 2010.

FIELD OF THE PRESENT INVENTION

The present invention is directed to a tennis skill training device and method of using the device particularly to train a user to properly serve a tennis ball to commence a game of tennis. The device is inexpensive to construct yet highly effective in developing the appropriate server stroke.

BACKGROUND OF THE INVENTION

Tennis training aides are well known in many forms. Despite the plethora of such devices, there has not been, to date, a device having particular utility and effectiveness for training one to properly serve a tennis ball to commence a match.

It is well recognized that the single most important aspect of the mechanics of a tennis serve is that the hitting arm is fully extended upward during the striking motion. Although one might think this would be a relatively simple matter to master, if not most, novice tennis players find this to be quite difficult. Stated differently, it is critical for an appropriate service stroke that the racquet meets the ball at full extension.

One way some players make themselves reach up for the ball is by keeping the entire arm straight throughout the swing. This "windmill serve" puts a tremendous strain on one's shoulder and could result in shoulder damage. In addition, it is important that one bends one's elbow in preparation for striking the ball. The proper mechanics of the serving swing depends upon throwing the lower half of the arm upward from a deeply bent elbow to a straight one. With a loose wrist, this causes all of the energy coming from one's legs, torso and arm to be translated into whipping the racquet upward and forward at the ball. If one swings with a straight arm the racquet speed is limited by how fast the arm can rotate around one's shoulder joint. If one bends one's arm while keeping one's wrist loose, the whipping effect generates far greater racquet hit speeds.

As noted above, there has not been, to date, an effective device to encourage proper service motion.

It is thus an object of the present invention to provide a device for training a user to develop the appropriate mechanics for properly serving a tennis ball.

It is yet a further object of the present invention to provide a training tool to enable one to develop the proper mechanics for service of a tennis ball which is inexpensive to construct, simple and intuitive to use and which is devoid of undue complexity.

These and further objects will be more readily apparent when considering the following disclosure.

SUMMARY OF THE INVENTION

A tennis skill training device having a grip emulating a tennis racquet grip sized to be held by a user when employing the device for training. The device includes a grip, a single flexible umbilical having first and second ends, the first end being attached to and emanating from the distal end of the grip, and a weight attached to the second end of the umbilical.

The device is particularly suitable for carrying out a method of training a user to properly serve a tennis ball.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Figure 1:
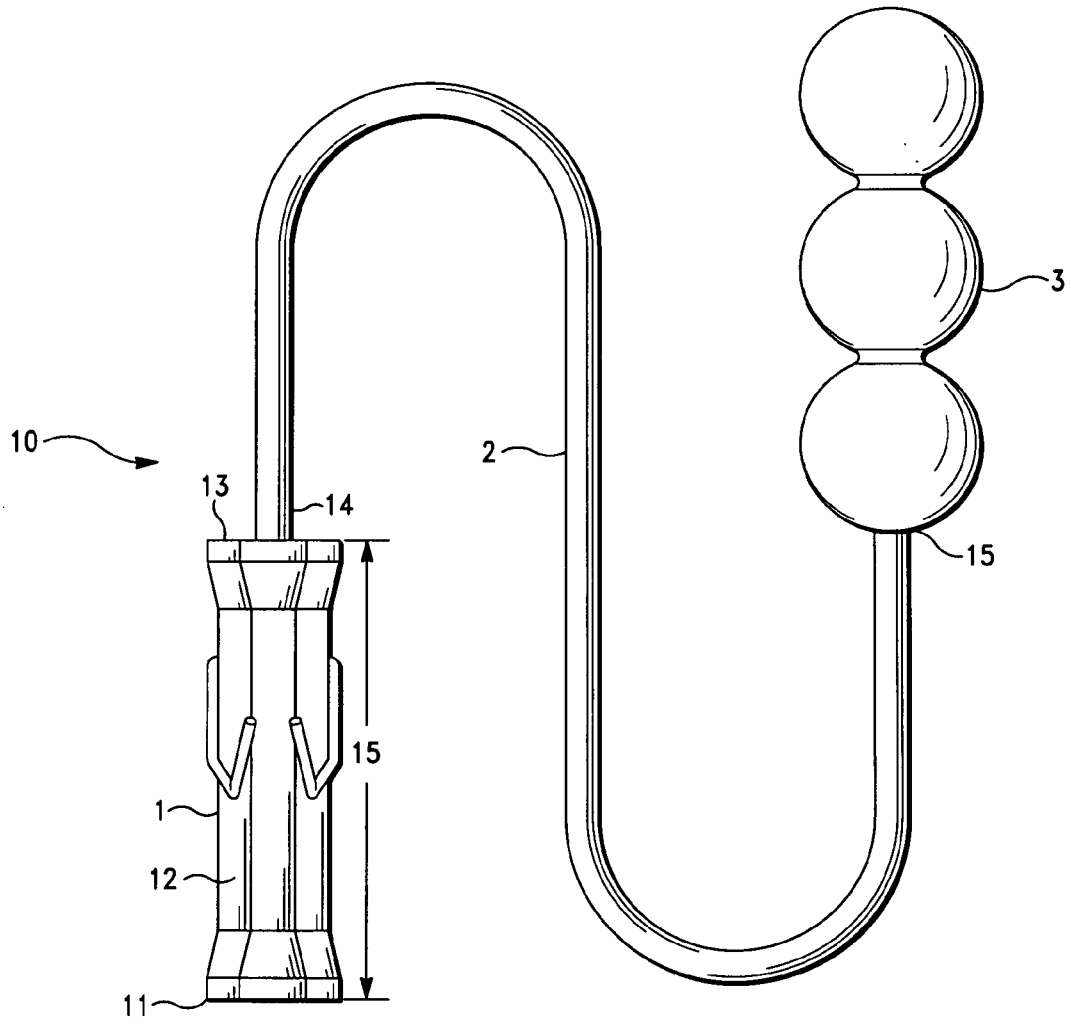
FIG. 1 is a front plan view of the device of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are the illustration description only and are not intended as definitions of the limits of the invention. The various features of novelty which characterize the invention are recited with particularity in the claims.

The present invention has been broadly described in the summary above. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore that the claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to the directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

It is recognized that in the game of tennis, the serve is the most complex and individual stroke. An efficient and powerful service motion is basically a throwing motion. The present invention, as noted, involves the use of flexible umbilical connecting a weighted end to a grip which represents the flexibility of the serving arm while allowing, or more appropriately, forcing the "links" of the shoulder, elbow, wrist and had to perform in a natural manner in creating maximum speed of the racquet head.

The weighted end of the device appended to the umbilical allows the training device of the present invention to create the appropriate motion for a user. It will virtually automatically create a "whip-like" motion to carry the weight to full and powerful extension of a service motion.

The flexible umbilical acts as a training device because it allows unlimited and three dimensional motion, unlike a straight bar or racquet. A tennis service motion is a multi-dimensional movement involving multiple joints with varying planes of movement. The shoulder is a ball in socket joint that allows the greatest range of motion in the body through a movement pattern called circumduction. The elbow is a hinge joint that allows movement through only one plane. The radio-ulnar and carpal-radius joints allow long axis rotation, and finally the wrist, a diathrodial joint, allows movement in two planes, flexion and extension as well as lateral deviation. Combined, these joints must allow force transferred from the ground, through the torso and racquet to create what is known as a spiral diagonal movement which is common to overhead sports motions.

A rigid device would not allow the neuromuscular movement patterns, aka "muscle memory" to be developed as it would act as a straight linkage between the ball and the body, whereas the flexible nature of the total serve more accurately mimics the multiple, moving joints in the upper extremity.

Because the majority of tennis players, and people in general, don't naturally have a good "throwing motion," it becomes necessary to use a practice aid or device to train the body to "throw" properly therefore crating a better service motion. The present invention stimulates an average tennis racquet in length and weight. It is weighted more heavily in the "head" and is attached to a flexible cord so that when going through a throwing or serving motion, the heavy end takes the user through the motion naturally by building momentum through the simulated stroke. Thus, the weight at the end of the umbilical tends to cause or develop the appropriate service motion.

Conversely, if the grip is not held properly and the motion is not correct, the player cannot complete the correct form. To facilitate this, as will be more readily developed below, the grip of the present device, as a preferred embodiment, has raised makers to suggest proper hand placement. If not properly used, one will not be able to keep the present device moving from start to finish in a fluid motion maintaining tautness of the umbilical.

In turning to FIG. 1, a first embodiment of the present invention is depicted. Specifically, a tennis skill training device 10 is provided with grip 1 emulating a tennis racquet grip sized for being held by a user when employing the device for training. The grip has a length 15 and an oval circumference best visualized in FIG. 5 showing butt cap 9, the circumference having eight flat beveled surfaces 12, again, for emulating the feel of a somewhat standard tennis racquet grip.

Figure 5:
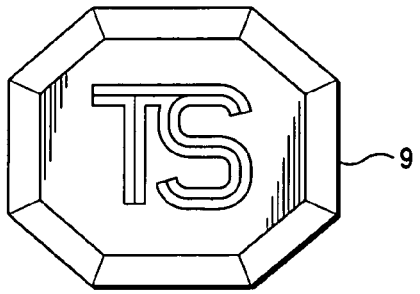
FIG. 5 is a bottom view of the butt piece of the grip of the present invention.

Grip 1 has a butt end 11 and distal end 13, the butt end generally finished with expanded cap 9 (FIG. 5). Flexible umbilical 2 has first end 14 attached to and emanating from distal end 13 of the grip 1 while weight 3 is attached to second end 15 of umbilical 2 to complete the device.

Although the device of the present invention, as depicted in FIG. 1, shows umbilical 2 bent in a serpentine fashion, when straightened, the total length of the device measured from butt end 11 of the grip 1 to the furtherest most end of the weight 3 is ideally sized to emulate the length of an average tennis racquet which is approximately 26" to 28". The umbilical, as a preferred embodiment, is not only flexible, but is capable of stretching approximately 1" from its at rest length as weight 3 pulls upon umbilical 2 during use of the present device. Suitable materials for use as the umbilical include a member selected from the group consisting of natural rubber, synthetic rubber and thermoplastic elastomers.

Although weight 3 is shown as three consecutively aligned weighted balls attached to umbilical 2 as shown, the present invention can use a single weighted orb or a plethora of such while remaining within the spirit and scope of the present invention. Ideally, weight 3 should cumulatively be approximately eight ounces to create the appropriate "head weight" sought herein.

Figure 2:
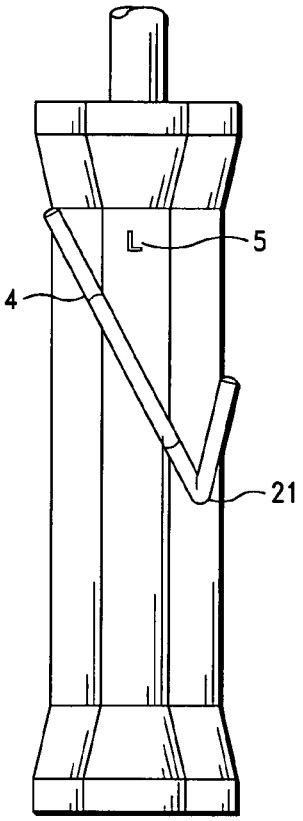
FIG. 2-4 are side and front plan views of a grip useful in practicing the present invention.
Figure 3:
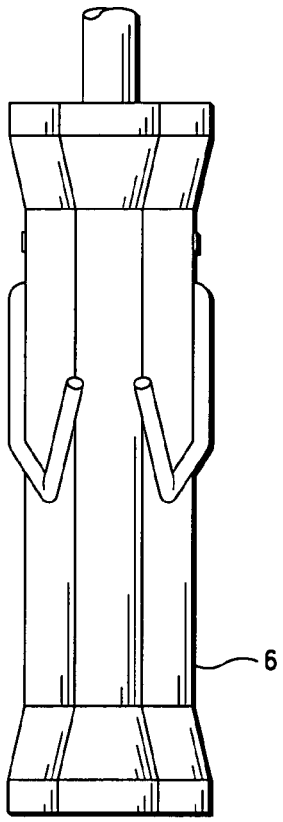
Figure 4:
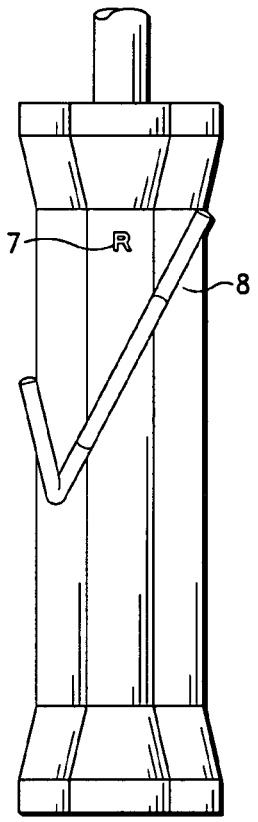

In turning FIGS. 2-4, grip 6 is shown. FIG. 3 shows the back side of grip 6 while FIGS. 2 and 4 show opposite sides of the grip in order to provide the appropriate illustration of raised markers 4 and 8. Specifically, raised marker 4 is intended to create a V or U-shaped series of segments establishing notch 21. When grip 6 is appropriately held by a user, notch 21 would nest in that portion of the user's hand between one's thumb and index finger. Raised marker 4 is intended to be used by a left handed player and its use is indicated by the letter "L" indicated as element 5.

Conversely, grip 6 can also be used by a right handed player by employing raised marker 8. Use of this marker is indicated by the letter "R" identified as element 7 thereof. To complete the device, butt end 11 of the grip includes expanded or butt cap 9 to prevent the grip from slipping out of a user's hand.

The prevent device, when employed properly will encourage a user to engage in a service stroke with the user's arm fully extended upward. Failure to do so will prevent umbilical 2 from remaining taut throughout the motion resulting in an uncontrolled movement of weight 3. This results in a clear indicator to a user that the stroke has not been carried out properly. A user would continue to employ the present device repeatedly until the stroke was properly executed as indicated by the tautness and slight stretching of umbilical 2 and thus the controlled arc o swing of weight 3.

The above disclosure is sufficient to enable one of ordinary skill in the art to practice the invention, and provides the best mode of practicing the invention presently contemplated by the inventor. While there is provide herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features of the like.

Therefore, the above description and illustration should not be considered as limiting the scope of the invention, which is identified by the appended claims.

What is claimed is:

1. A tennis skill training device, the device consisting of:

a grip emulating a tennis racket grip, said grip being sized for being held by a user when employing said device for training, said grip having a length, a circumference, a butt end and a distal end;

a single flexible and extendable umbilical having first and second ends, said first end being attached to and emanating from said distal end of said grip, said umbilical being capable of stretching and extending along its axis approximately 1 in from an initial unstretched length; and a first fixed weight attachable to said second end of said umbilical, said first weight having a weight in the range of approximately 13-15 oz, whereby when said first fixed weight is attached to said umbilical and said device is subjected to rotational motion in a vertical plane by a user's arm said device generates a first angular momentum, whereby said umbilical stretches from first at-rest length to a second extended length, and whereby said device exerts an outwardly directed first force on said user's arm that tends to extend said user's arm.

2. The device of claim 1, wherein said grip includes eight flat beveled surfaces about said grip circumference.

3. The device of claim 1, wherein said grip includes a raised marker on said grip circumference that indicates proper hand placement during use of said device.

4. The device of claim 3, wherein said grip includes two raised markers, said raised markers comprising a first marker for left handed users and a second marker for right handed users.

5. The device of claim 1, wherein said umbilical is constructed from a material selected from the group consisting of natural rubber, synthetic rubber and thermoplastic elastomers.

6. A tennis skill training device, the device consisting of:

a grip emulating a tennis racket grip, said grip being sized for being held by a user when employing said device for training, said grip having a length, a circumference, a butt end and a distal end;

a first flexible and extendable umbilical having a longitudinal axis and first and second ends, said first end being attached to and emanating from said distal end of said grip, said first umbilical being capable of stretching and extending along its axis approximately 1 in from an initial unstretched length; and a first fixed weight attachable to said second end of said first umbilical, said first weight having a weight in the range of approximately 13-15 oz, whereby when said first fixed weight is attached to said first umbilical and said device is subjected to rotational motion in a vertical plane by a user's arm said device generates a first angular momentum, whereby said first umbilical is allowed to freely rotate about said longitudinal axis and stretches from first at-rest length to a second extended length.

* * * * *